US005678330A

United States Patent [19]

Van Dyke et al.

[11] Patent Number: 5,678,330

[45] Date of Patent: Oct. 21, 1997

[54] SHOE WITH INTEGRAL ANKLE SUPPORT AND IMPROVED ANKLE BRACE APPARATUS

[75] Inventors: Mark W. Van Dyke, Pittsburgh, Pa.; Gianfranco Gramola; John Benton Price, both of San Antonio, Tex.

[73] Assignee: NKI-TM, Inc., Wilmington, Del.

[21] Appl. No.: 485,459

[22] Filed: Jun. 7, 1995

Related U.S. Application Data

[63] Continuation-in-part of Ser. No. 176,336, Jan. 3, 1994, abandoned, which is a continuation of Ser. No. 878,748, May 5, 1992, abandoned, which is a continuation-in-part of Ser. No. 630,450, Dec. 20, 1990, Pat. No. 5,109,613, which is a continuation of Ser. No. 369,267, Jun. 21, 1989, abandoned.

[51] Int. Cl.[6] ..... A43B 7/20

[52] U.S. Cl. ..... 36/89; 36/114; 36/69

[58] Field of Search ..... 36/89, 90, 58.6, 36/107, 114, 132, 69; 602/27

[56] References Cited

U.S. PATENT DOCUMENTS

| | | | |
|---|---|---|---|
| 746,338 | 12/1903 | Keen . | |
| 765,024 | 7/1904 | Lueck . | |
| 912,862 | 2/1909 | Lendgren . | |
| 1,205,206 | 11/1916 | Hofmeister | 36/89 |
| 1,441,677 | 1/1923 | Golden | 36/89 |
| 1,549,382 | 8/1925 | Riddell . | |
| 1,610,700 | 12/1926 | Morton | 36/89 |
| 1,692,896 | 11/1928 | Hilgert . | |
| 2,444,428 | 7/1948 | Carrier . | |
| 2,634,515 | 4/1953 | Saitta . | |
| 2,918,734 | 12/1959 | Hyde . | |
| 2,972,822 | 2/1961 | Tanner . | |
| 3,064,644 | 11/1962 | Patterson . | |
| 3,298,365 | 1/1967 | Lewis . | |
| 3,537,716 | 11/1970 | Norgiel . | |
| 3,613,273 | 10/1971 | Marquis . | |
| 3,674,023 | 7/1972 | Mann | 128/166 |
| 3,948,253 | 4/1976 | Burke | 128/80 |
| 3,955,565 | 5/1976 | Johnson, Jr. . | |
| 4,280,489 | 7/1981 | Johnson, Jr. | 128/80 |
| 4,287,920 | 9/1981 | Johnson, Jr. | 141/85 |
| 4,402,146 | 9/1983 | Parracho et al. | 36/129 |
| 4,433,682 | 2/1984 | Badra | 128/153 |
| 4,440,158 | 4/1984 | Shapiro | 128/80 |
| 4,510,701 | 4/1985 | Schour et al. | 36/68 |
| 4,510,927 | 4/1985 | Peters | 128/80 |
| 4,517,968 | 5/1985 | Greene et al. | 128/80 |
| 4,523,394 | 6/1985 | Lindh et al. | 36/89 |
| 4,546,555 | 10/1985 | Spademan | 36/28 |
| 4,554,912 | 11/1985 | Haberman | 128/80 |
| 4,590,932 | 5/1986 | Wilkerson | 128/166 |
| 4,628,918 | 12/1986 | Johnson, Jr. | 128/90 |
| 4,628,945 | 12/1986 | Johnson, Jr. | 128/80 |
| 4,630,600 | 12/1986 | Spencer et al. | 128/80 |
| 4,662,088 | 5/1987 | Autry et al. | 36/105 |

(List continued on next page.)

FOREIGN PATENT DOCUMENTS

| | | |
|---|---|---|
| 8704354.8 | 7/1988 | Germany . |
| 8704102.2 | 9/1988 | Germany . |
| 57343 | 3/1984 | Taiwan . |

OTHER PUBLICATIONS

Stover, "Patient's Guide—Functional Management of a Sprained Ankle with an Air–Stirrup Ankle Brace" (1987).

Gould, "FIGS. 2.26, 2.27, 2.28A and B Ancillary Studies", *The Foot Book*, pp. 49 and 51.

*Primary Examiner*—Ted Kavanaugh

*Attorney, Agent, or Firm*—Testa, Hurwitz & Thibeault, LLP

[57] ABSTRACT

A shoe with an integral ankle support preferably for, but not limited to, an athletic shoe, has a plurality of adjustable straps and brace members attached to a shoe upper. The brace members provide semi-rigid support and are attached medially and laterally to the upper inner surface with a rivet in each brace member, thereby allowing movement of the brace members in an anterior and posterior direction about an axis defined by the rivets. An improvement of the integral ankle support includes the use of a combination heel and ankle support incorporated into the construction of a shoe.

24 Claims, 14 Drawing Sheets

U.S. PATENT DOCUMENTS

| | | | |
|---|---|---|---|
| 4,676,011 | 6/1987 | O'Rourke et al. | 36/89 |
| 4,719,926 | 1/1988 | Nelson | 128/80 |
| 4,727,863 | 3/1988 | Nelson | 128/80 |
| 4,766,681 | 8/1988 | O'Rourke et al. | 36/89 |
| 4,776,111 | 10/1988 | Crowley | 36/89 |
| 4,809,686 | 3/1989 | Crane | 128/80 |
| 4,922,630 | 5/1990 | Robinson | 36/89 |
| 4,947,560 | 8/1990 | Fuerst et al. | 36/88 |
| 4,989,350 | 2/1991 | Bunch et al. | 36/89 |
| 5,056,509 | 10/1991 | Swearington | 36/89 |
| 5,090,138 | 2/1992 | Borden | 36/89 X |
| 5,109,613 | 5/1992 | Van Dyke | 36/89 |
| 5,158,767 | 10/1992 | Cohen et al. | 36/93 |
| 5,177,884 | 1/1993 | Rullier | 36/89 X |
| 5,226,875 | 7/1993 | Johnson | 36/89 X |

SHOE WITH INTEGRAL ANKLE SUPPORT AND IMPROVED ANKLE BRACE APPARATUS

This is a continuation-in-part of application of Ser. No. 08/176,336 filed Jan. 3, 1994, abandoned which was a continuation of application Ser. No. 07/878,748 filed May 5, 1992, abandoned which was a continuation-in-part of application Ser. No. 07/630,450 filed Dec. 20, 1990, now U.S. Pat. No. 5,109,613, which was a continuation of application Ser. No. 369,267, filed Jun. 21, 1989, now abandoned, and the contents are incorporated herein by reference.

BACKGROUND OF THE INVENTION

The present invention relates to a shoe providing an integral ankle support and pertains, more particularly, to an athletic or activity shoe providing ankle support and protection for a wearer's talofibular and talotibial joints from external and internal rotation. The shoe of this invention is an improvement over the conventional ankle tape, elastic tape, and ankle braces.

The present invention further relates to an improvement in an ankle brace apparatus for use in shoes and pertains, more particularly, to an apparatus constructed for use within an athletic shoe upper. The ankle brace apparatus of this invention is a further improvement over conventional ankle tape, elastic tape, and ankle braces.

An ankle joint consists of three bones (the tibia, fibula, and talus) united by several ligamentous structure, the bone and ligament combination providing ankle joint motion in three planes while still providing a relatively stable joint. A weakness inherent in the motion of the ankle joint stems from the capability of the ankle joint to move in any of the three planes.

Ankle sprains are the most frequent injury to the lower extremity below the knee. A major cause of ankle injuries relates to movement of the talogibular and talotibial joint, more particularly, an internal and external rotation about these joints. It is proposed that an ankle sprain could be caused as a result of a lower portion of a foot remaining stationary and the tibia and fibula sustaining a forced rotation in either an internal or an external fashion causing ligaments about the ankle joint to tear.

With the conventional ankle supporting methods and devices it is generally viewed necessary to protect against ankle injury by supporting and protecting the ankle and in particular to restrict ankle joint motion in any unintended direction. This is the general accepted purpose behind the practice of taping ankles, wrapping ankles in elastic tape, or providing some form of an ankle brace to be worn alone or in conjunction with a shoe.

These conventional ankle braces are typically constructed using rigid shell-like or support members attached to a shoe outer surface or to the leg and ankle of the wearer. Some of these braces are actually intended primarily as a shin or ankle guard; or stiffening members inserted into interior pockets formed on the inside surface of the portion of the shoe upper covering the ankle or stiffeners in a sock-like brace with straps further binding the shoe upper or brace around the ankle.

Conventional braces also may be considered to include the variety of rigid orthopedic clamps worn either separately or with or as part of a specially constructed shoe, rigid foot plate or sole. Furthermore, it is known to incorporate air-inflatable devices or air bags into the conventional ankle supports and related devices.

Accordingly, it is an object of the present invention to provide a shoe with an integral ankle support that is adapted to control internal and external rotation of a rear portion of a wearer's foot.

Another object of the present invention is to provide a shoe with an integral ankle support that has a construction intended to impede or prohibit internal and external rotation of the rear portion of the foot about the talofibular and talotibial joint. With the shoe construction of this invention it is desired to limit the indicated rotation in a manner not effectively accomplished by conventional constructions.

A further object of the present invention is to provide a shoe with an integral ankle support internally connected or associated with the shoe for providing support to the ankle and prohibiting as much as possible the talogibular and the talotibial joints from undergoing external and internal rotation.

Still another object of the present invention is to provide a shoe with an integral ankle support that is constructed to provide opposing braces individually attached to the shoe and a lower portion of a heel cup of the shoe. The brace arrangement of this invention provides for free anterior and posterior brace rotation or pivoting.

Still a further object of the present invention is to provide a shoe with an integral ankle support constructed form generally rigid thermoplastic material.

Another object of the present invention is to provide a shoe with an integral ankle support including an ankle brace attachment and adjustment strap system. The shoe of this invention incorporates adjustable straps effectively joining the brace members, including an anterior strap across the ankle. The straps may include an adjustable anterior strap for compressing the brace members and a distal lower portion of the brace members hinged for pivoting movement relative to the shoe.

A further object of the present invention is to provide an ankle support apparatus that is adapted for incorporation into a shoe thereby becoming a substantially integral part of the shoe during the manufacturing process.

Thus, this invention provides a shoe and brace system combination providing means for limiting eversion and inversion and internal and external rotation of the tibia and fibula while allowing full-range motion in the dorsi and planter flexion plan.

SUMMARY OF THE INVENTION

To accomplish the foregoing and other objects of this invention there is provided a shoe with an integral ankle support for restricting a wearer's talogibular and talotibial joints from external and internal rotation. The shoe comprises means for providing ankle support and inhibiting internal and external rotation of a rearward portion of a foot supported by the shoe. The inhibiting means forms an integral part of the shoe and allows full-range dorsi and planter flexion of the foot. The inhibiting means can be an ankle brace incorporated into the shoe. For instance, the ankle brace can be incorporated into the shoe by sewing it in place. The ankle can include a generally rigid media brace member and an opposing generally rigid lateral brace member pivotally attached to the shoe. The brace may also include a generally rigid heel portion pivotally attached to the media and lateral brace members and the shoe.

The shoe of this invention further includes means for securing the inhibiting means in generally compressive communication with the ankle joint so as to provide the desired limitation of foot and ankle joint motion. The inhibiting means comprises medial support means and opposing lateral support means for limiting eversion and inversion and internal and external tibia and fibula rotation. The support means is pivotally associated with respective media and lateral shoe upper portions.

The securing means may comprise an adjustable strap system operatively associated with the shoe and inhibiting means that provides an adjustable and compressive influence on the inhibiting means and into abutting relationship with the ankle joint. A shoe incorporating the integral ankle support of this invention further comprises a plurality of adjustable straps members operatively associated with support means and the shoe.

A shoe incorporating the integral ankle support as set forth for the present invention includes intermediate brace support means that protect the foot from abrasive contact with brace means, such that the shoe may be worn for relatively extensive periods without abrasion or discomfort.

A shoe providing this invention will typically include an upper portion and a sole portion, the upper portion including a vamp portion with medial side portion and lateral side portion and a heel counter portion. The sole includes an outer sole and an inner sole with a heel cup at the shoe posterior for receiving the heel of the wearer. The vamp portion can be a one piece member or a split vamp member which includes upper and lower vamp portions.

The securing means may further include a combination of a strap and laces. In an improved preferred embodiment shown and described herein, an upper strap and shoe laces are substituted for the lower adjustable strap of another preferred embodiment of the present invention.

This combination of laces (which are adjustable) and the upper adjustable strap provide the desired compression of the ankle brace apparatus incorporated into the shoe. The ankle brace apparatus is incorporated into the interior of the shoe construction and extends around a heel portion of a wearer's foot as well as supporting the ankle of the wearer's foot.

These and other objects and features of the present invention will be better understood and appreciated from the following detailed description of embodiments thereof, selected for purposes of illustration and shown in the accompanying drawings.

DETAILED DESCRIPTION

Figure 1:
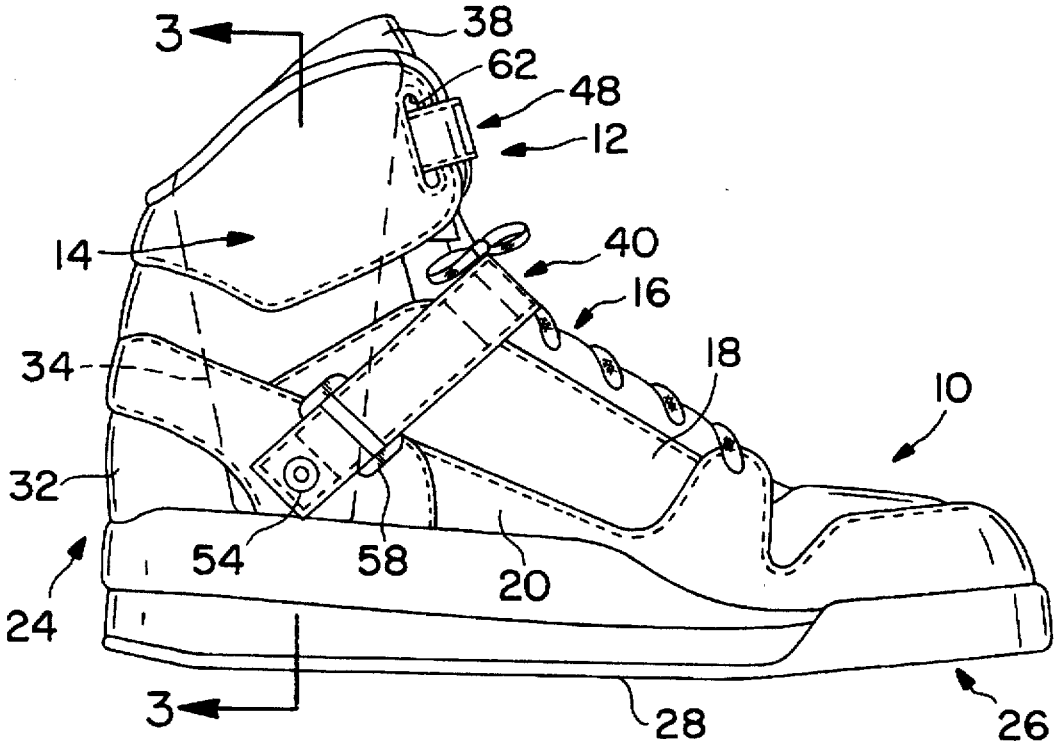
FIG. 1 is a lateral side elevational view of a shoe constructed in accordance with the present invention.

Referring now to the drawings there is shown a preferred embodiment for the shoe with an integral ankle brace of this invention. The shoe is described in connection with an athletic shoe typically known as a "hightop" model. The shoe and brace construction of the present invention is particularly adapted for providing increased ankle support and substantially inhibiting internal and external rotation of the talofibular and talotibial joints. The ankle is supported and protected from sprain and tearing of the ligaments about the ankle joint.

The drawings show an athletic shoe 10 and an associated and internally attached ankle brace system 12. The ankle brace system 12 includes an ankle brace attachment and adjustment strap system 14. The athletic shoe 10 includes a shoe upper 16 and a vamp portion 18.

Further constructions of the athletic shoe 10 include a medial side portion 20, an opposing lateral side portion 22, and a heel counter portion 24. The athletic shoe 10 also includes a combination sole 26 with its outer sole 28 and inner sole 30. A heel cup 32 is located at the rearward portion of the shoe 10.

The internally attached ankle brace system 12 and ankle brace attachment and adjustment strap system 14 includes a plurality of brace means for substantially inhibiting a wearer's talofibular and talotibial joints from external and internal rotation. The brace combination includes a medial brace member 34 and a lateral brace member 36. The brace combination becomes an integral part of the high-top athletic shoe 10 in part through the ankle brace attachment and adjustment strap system 14.

A conventional tongue and lacing system are adequate for the present invention. It will be understood that straps may be substituted for the laces, or a combination of straps and laces. The brace members 34 and 36 may be a thermoplastic material.

The brace members 34 and 36 are operatively attached to the shoe 10 with suitable hinge means for providing anterior and posterior brace member 34 and 36 movement. Adjustable strap means provide for adjustably positioning the brace members 34 and 36 about the ankle of the wearer. A hinge means 118 operatively associated with the brace members 34, 36 and the shoe provide for further brace adjustment in concert with the strap means.

A liner means provides a cushion and protective layer between the inner surface and the rigid brace members 34, 36 and the foot of the wearer. Each brace member is padded for the wearer's comfort and to increase the adjustability of any associated strap means. Strap means are located and operatively associated with the upper portion of the respective brace members 34, 36.

The medial and lateral brace members are further adjustable by means of another strap means operatively associated with the brace members and adjustable across the ankle joint dorsum. It will now be understood that as described herein and as set forth in further detail below, that the brace and strap configuration of this invention provides for normal anterior and posterior ankle joint motion, or planter and dorsal ankle joint motion or flexion while restricting or inhibiting ankle joint internal and external rotation.

The illustrated embodiments show the brace members 34 and 36 attached by pin or hinge members to the shoe in order to provide an integration of shoe and brace system. The brace may be a semi-rigid thermoplastic material. The braces may be padded for a more comfortable fit and extended wear, especially, active wear of the shoe. Typically, the present invention includes padding means for both the medial and lateral brace. Both the medial brace padding 42 and the lateral brace padding 44 may be a neoprene rubber material.

It is believed that the more rigid the brace material, then the more of a limitation to the occurrence of a sprain of the types the present invention to avoid that is provided. A shoe of the present invention typically includes a relatively soft inner sole inner lining or sock liner 46. As illustrated in the drawings, a standard or conventional tongue and associated lacing system 38 provides for closure of the opposing medial and lateral side portions of the shoe's vamp portion.

The present invention further includes an adjustable anterior strap 40 as part of the attachment and adjustment strap system 14 provided for the purpose of tightening or cinching the shoe 10 and ankle brace system 12 down and over the mortuus of the ankle joint. The strap 40 angles generally downward as illustrated and is preferably attached to the medial and lateral side portions of the shoe at the pivot point for the brace means.

Another adjustment means provides for adjustable compression of the medial and lateral brace members 34, 36 closely against the bone arrangement defining the ankle joint.

In a preferred embodiment an upper adjustable strap 48 located at the top of the shoe connects the medial and lateral sides 20, 22 of the shoe 10. Strap 48 is preferably sewn directly to or otherwise operatively attached to the medial and lateral braces 34, 36. It will be understood that the function of strap 48 may be accomplished by lacing arrangements or a combination of a lacing and strap arrangement.

The medial and lateral brace members 34 and 36 are integrated into the structure of the shoe 10. The medial brace member 34 and the lateral brace member 36 are operatively connected to the shoe 10 by hinge means 54, 56 for allowing the anterior and posterior ankle joint movement (the plantar and dorsal flexion referred to previously) while the brace members are compressively held against the ankle joint by the adjustable strap assembly.

The medial and lateral brace members include distal portions 50, 52 and associated medial hinge means and lateral hinge means 54, 56. A medial hinge member 54 may include a rivet or similar pin member connected to the medial side portion 20 of the shoe 10. A lateral hinge member 56 may include another rivet or similar pin member connected to the lateral side portion 22 of the shoe 10.

The rivets attach medial and lateral hinge members 54 and 56, respectively, proximately below the malleolus of the wearer and above the junction of the sole 26 and the upper 16. It will be recognized that this placement corresponds to the location of the joint (i.e., the subtalor joint) comprised of the talus and the calcaneus of the wearer.

The medial and lateral brace members or stabilizers 34 and 36 prevent rotation of the sub-talor joint about the foot's longitudinal axis. The hinge members 54, 56 are proximate the axis of the respective malleoli but at the subtalor joint not the malleolus itself.

The adjustable anterior strap 40, (a dorsal strap in view of its position away from the sole of the shoe) can also be understood as a subtalor strap that passes through the rivets or pivot positions of the medial and lateral brace members 34, 36.

The adjustable anterior dorsal strap 40 approximates or parallels an imaginary axis transverse to the longitudinal axis of the foot and through the subtalor joint to generally hold the subtalor joint in a desired neutral position. The strap 40 also may be considered an anterior tibial strap in view of its proximate location to the wearer's tibia.

In a preferred embodiment the anterior strap 40 is positioned at an angle of approximately forty degrees (40°) above a horizontal plane. The strap member 40 is held against the outer lateral side portion 20 of the shoe 10 by the head of the lateral rivet 56. The strap member 40 includes a ring member 58 of plastic, metal, or other suitable material. The ring member 58 receives the strap member 40 which is then folded back over itself and adjustable and secured by suitable fastening means.

It is known that the axis of the subtalor joint is elevated approximately 41° with respect to an imaginary horizontal plane through the subtalor joint. *The Foot Book*, edited by John S. Gould, M.D., Williams & Wilkens, is incorporated herein by reference.

Figure 2:
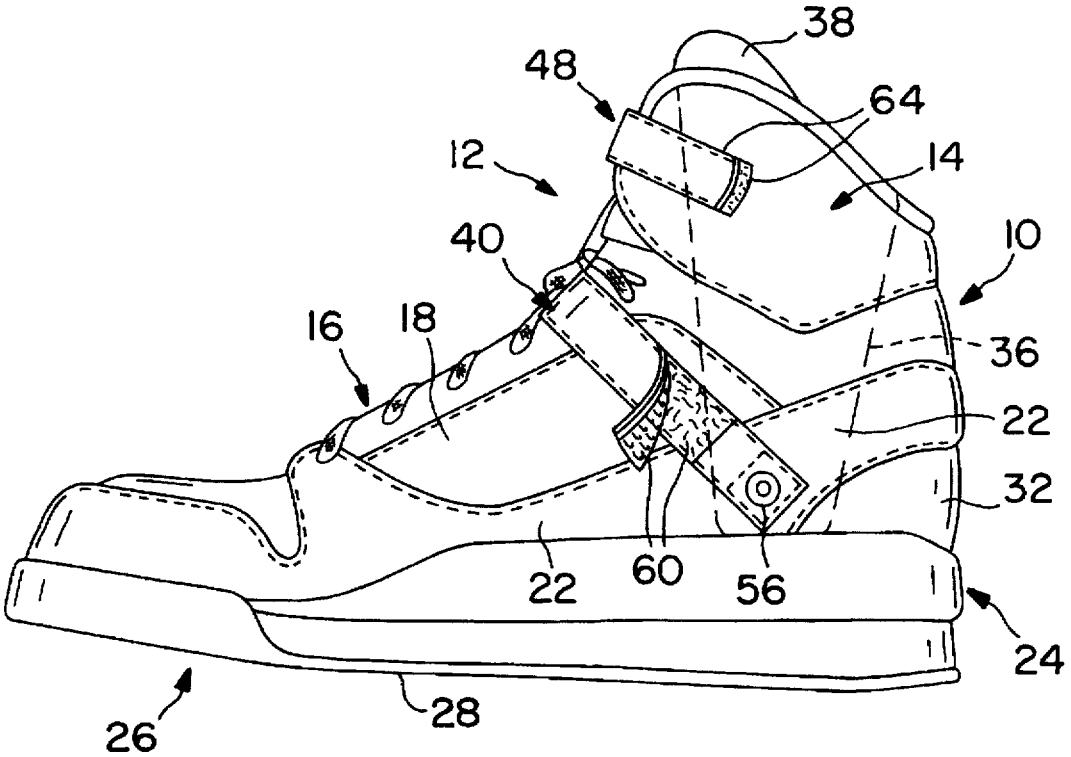
FIG. 2 is a medial side elevational view of the shoe depicted in FIG. 1.
Figure 3:
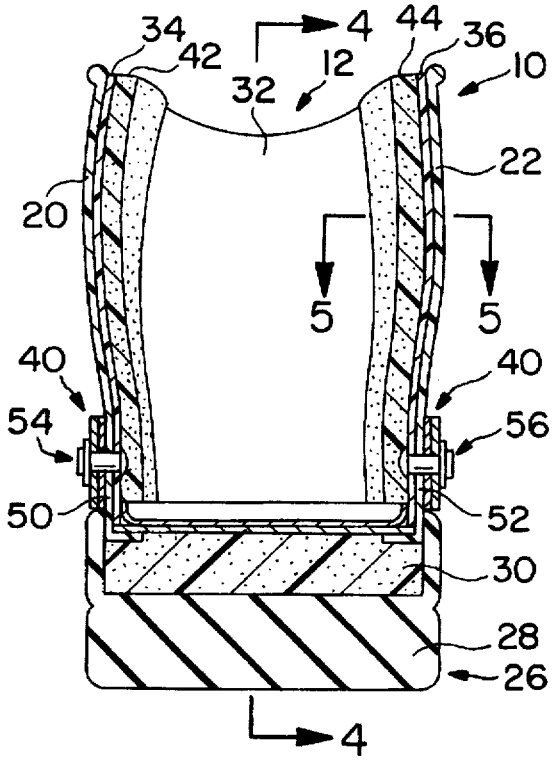
FIG. 3 is a cross-sectional view taken along line 3—3 in FIG. 1.
Figure 6:
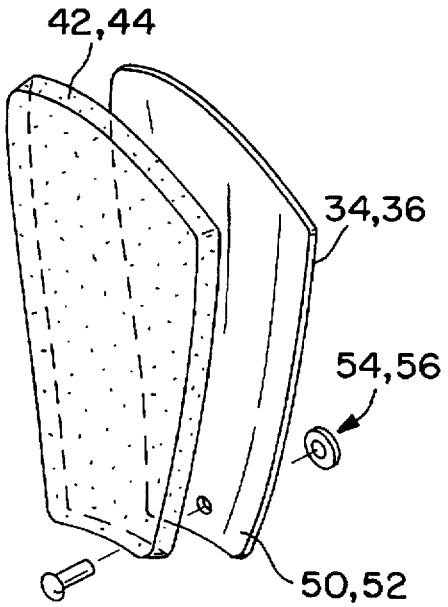
FIG. 6 is an exploded view of a preferred embodiment of the brace and hinge arrangement of this invention.
Figure 4:
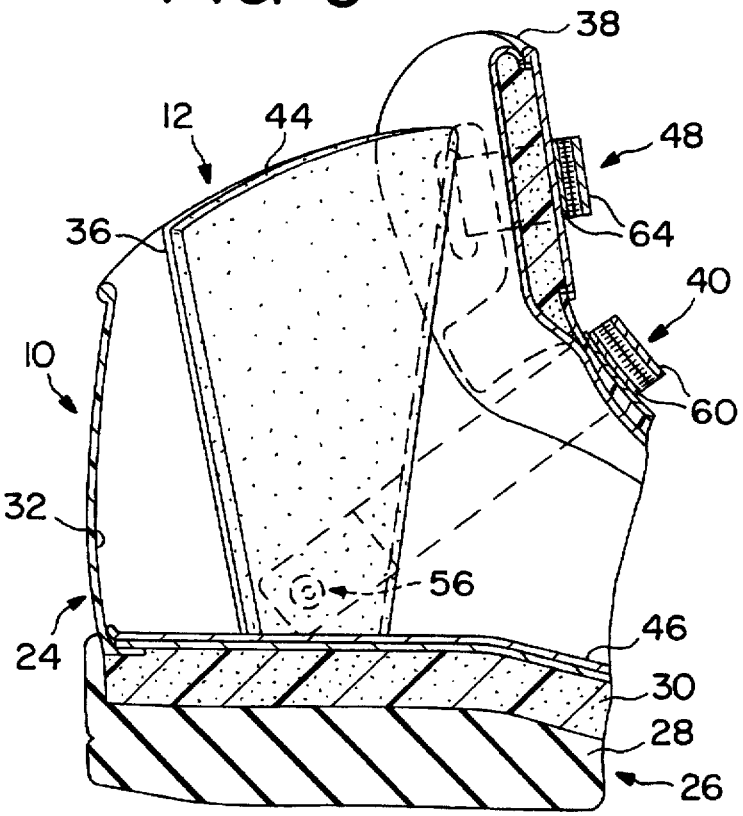
FIG. 4 is a cross-sectional view taken along line 404 in FIG. 3.
Figure 5:
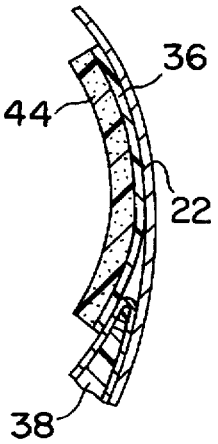
FIG. 5 is a cross-sectional view taken along line 5—5 in FIG. 3.
Figure 7:
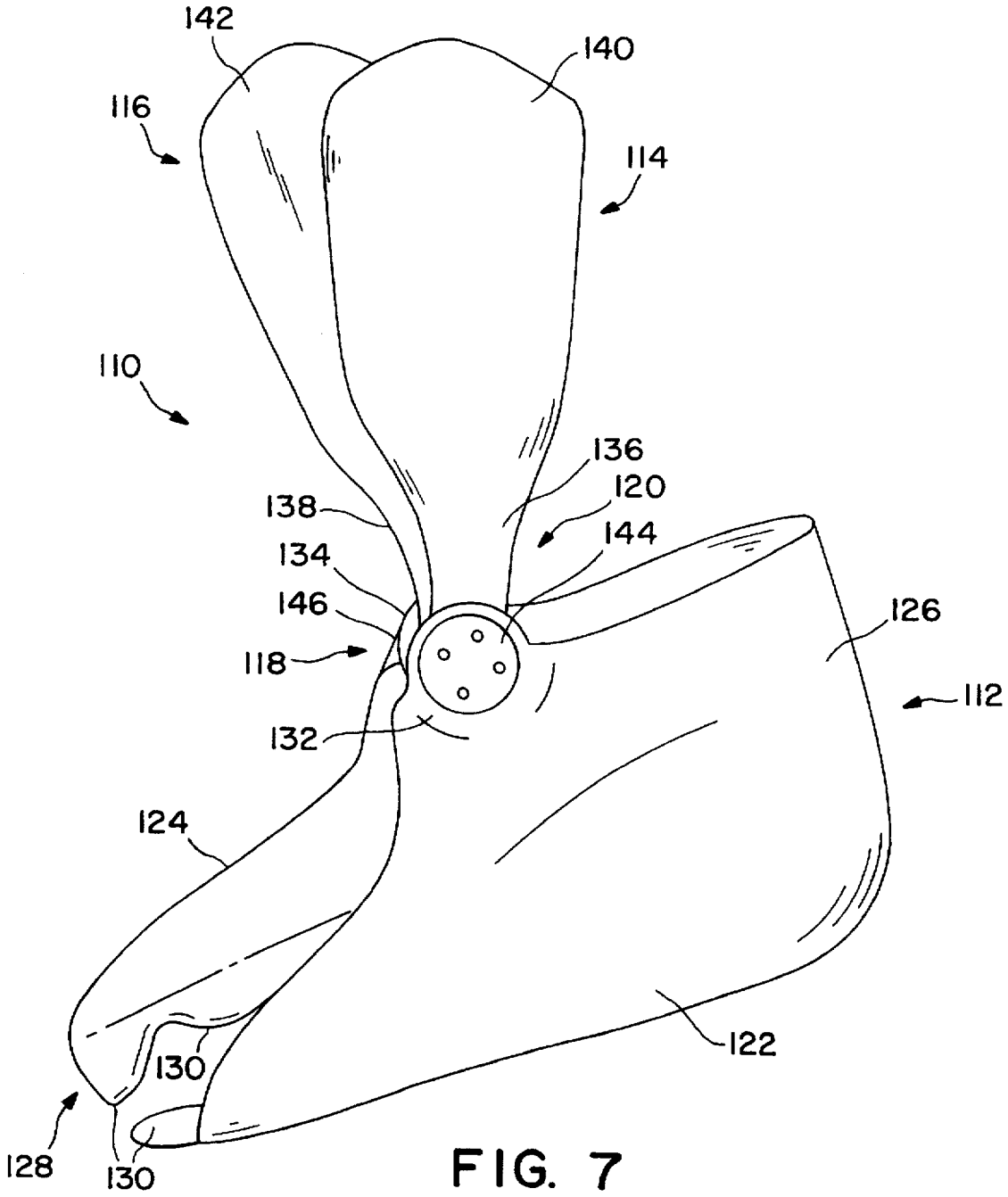
FIG. 7 is a perspective view of an ankle brace apparatus constructed in accordance with a preferred embodiment of the improvement of the present invention.
Figure 8:
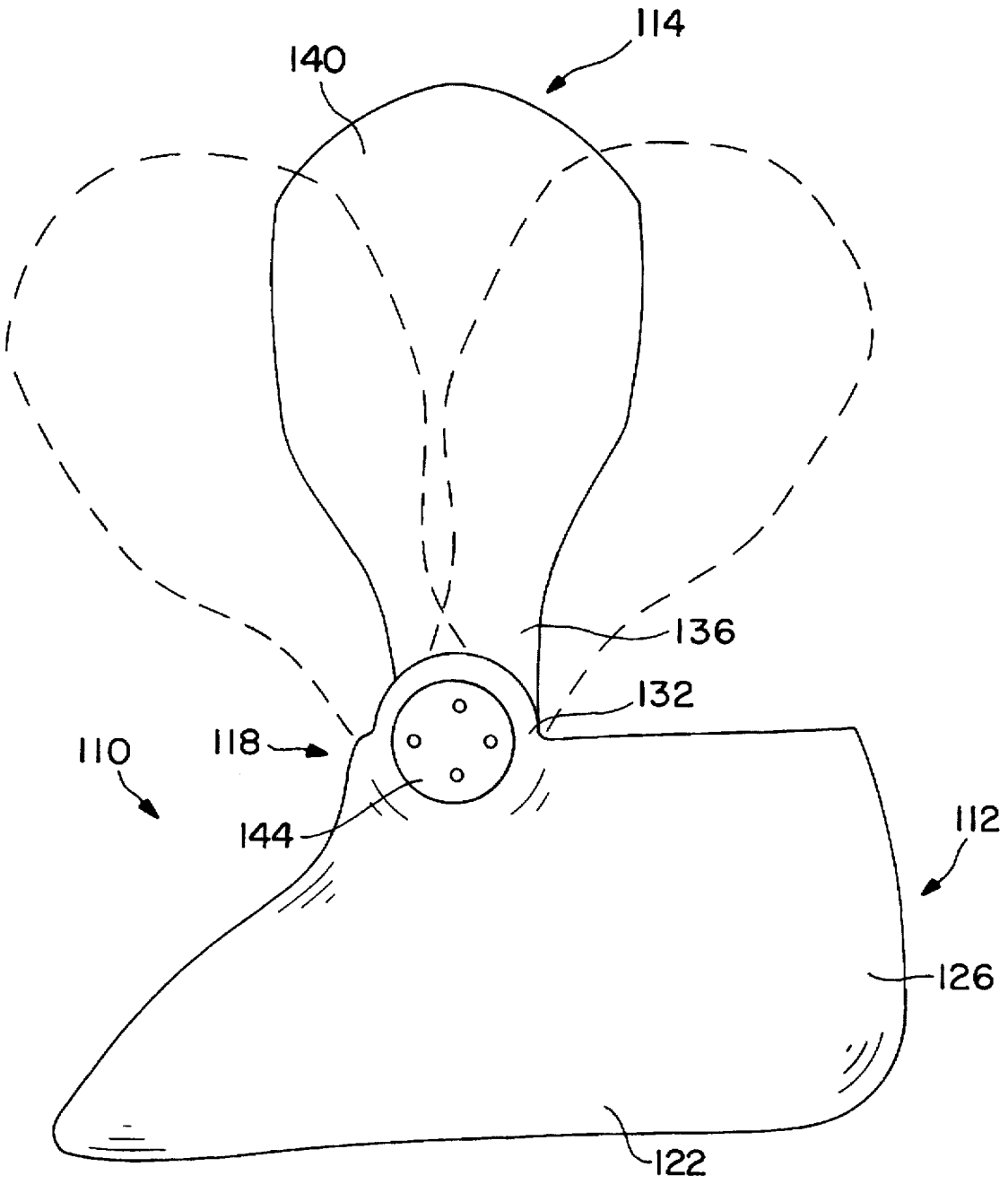
FIG. 8 is a side elevational view of the ankle brace apparatus depicted in FIG. 7.
Figure 9:
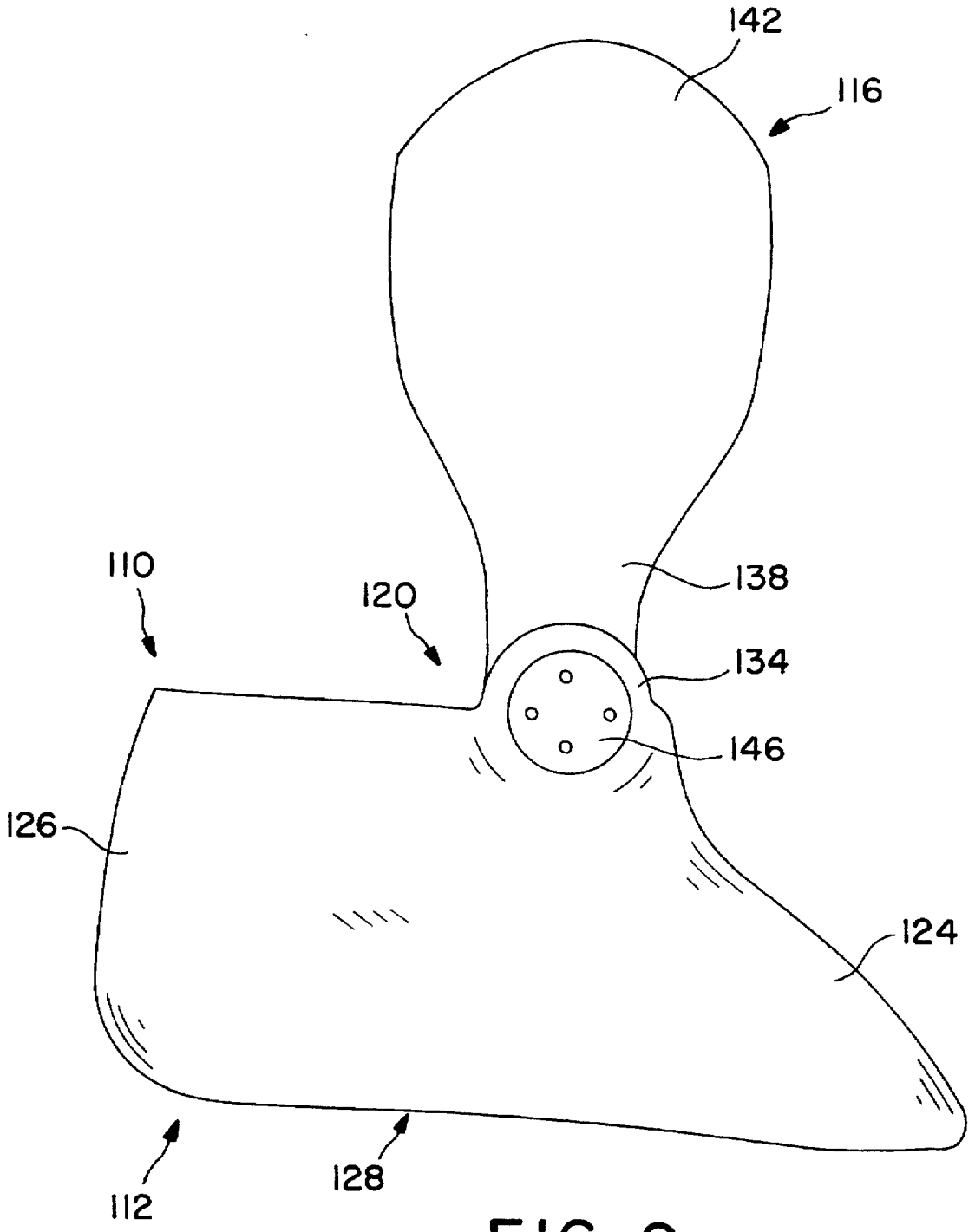
FIG. 9 is an opposing side elevational view of the ankle brace apparatus depicted in FIG. 7.
Figure 10:
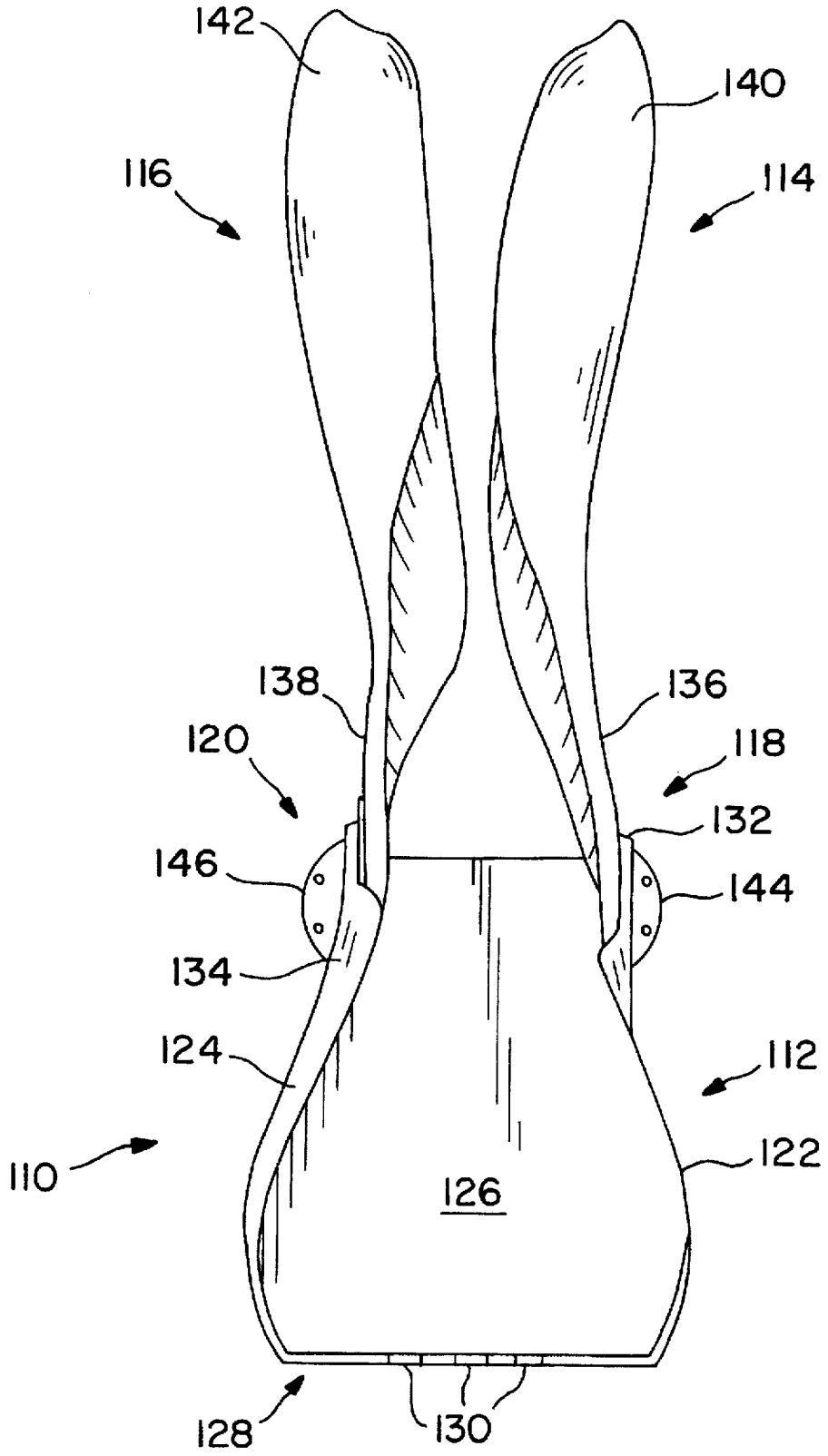
FIG. 10 is a front elevational view of the ankle brace apparatus depicted in FIG. 7.
Figure 11:
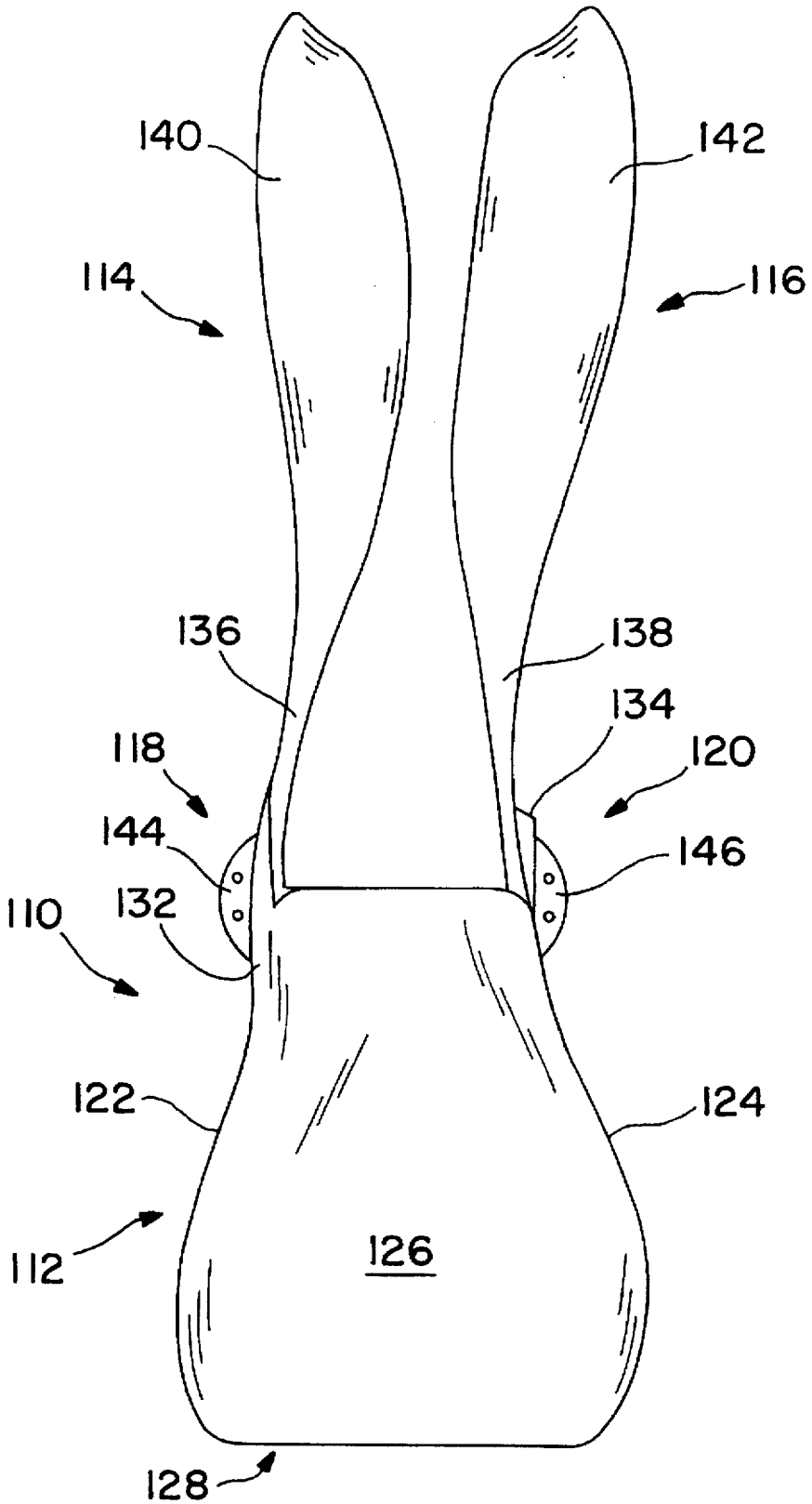
FIG. 11 is a rear elevational view of the ankle brace apparatus depicted in FIG. 7.
Figure 12:
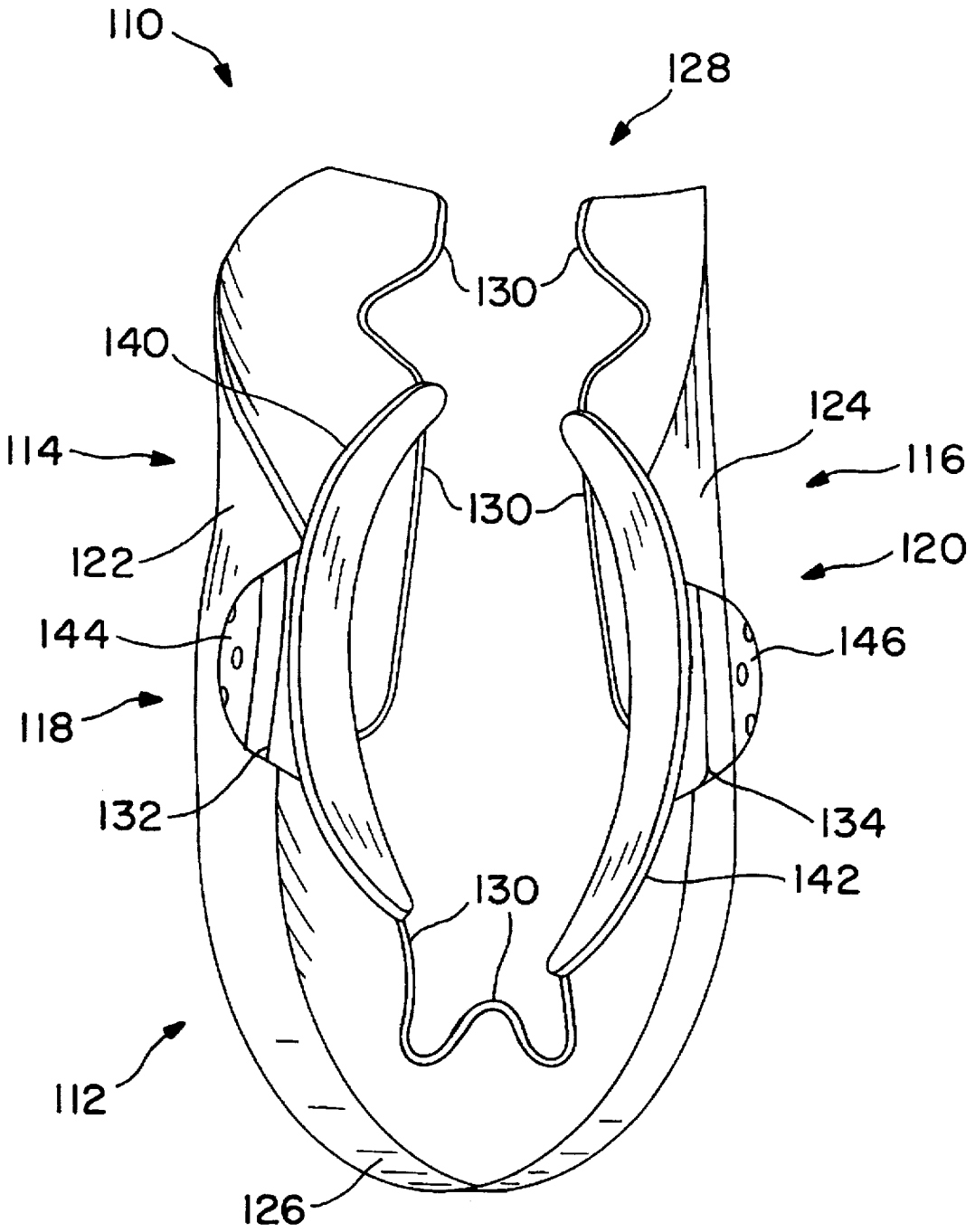
FIG. 12 is a top plan view of the ankle brace apparatus depicted in FIG. 7.
Figure 13:
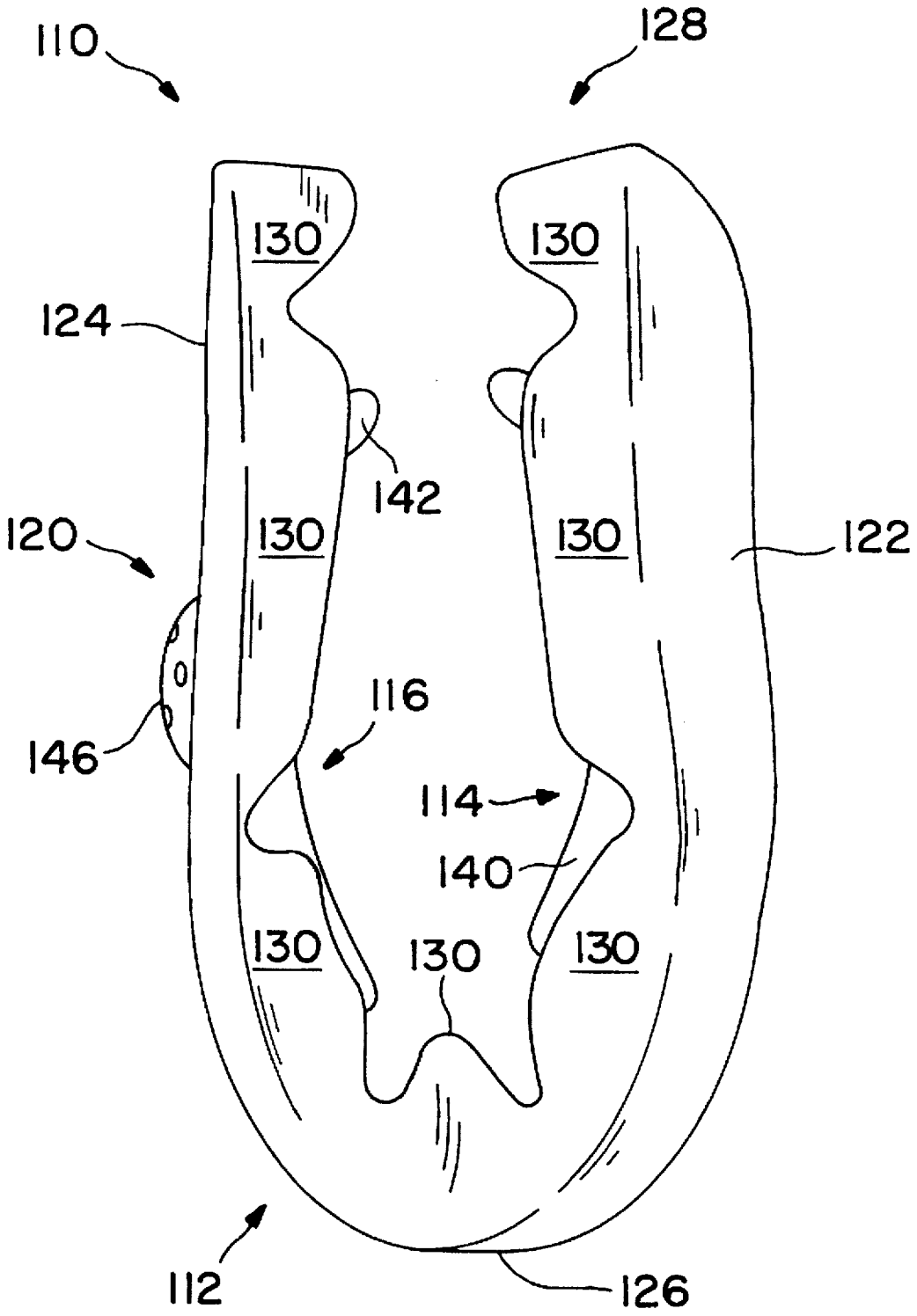
FIG. 13 is a bottom plan view of the ankle brace apparatus depicted in FIG. 7.

Particular reference is made to Page 51 and FIG. 2.28B illustrating the axis of the subtalor joint. The brace and strap arrangement of this invention, including the combination of the placement of the brace pivots and the rivets for attaching the subtalor strap which extends forward over the foot at the angle of approximately 40° endows the shoe with the desired stability.

The upper adjustable strap 48 is positioned across the shoe upper so as to prevent or at least hinder any sliding motion of the wearer's tibia within the shoe. The upper adjustable strap 48 also prevents or at least hinders rotation of the tibia and the fibula. In this manner the possibility of the occurrence of a sprain or related injury is reduced for the wearer of the shoe of the present invention. The arrangement of straps and braces thereby provide strapping and stiffening above and below the malleoli.

In a preferred embodiment the fastening means is provided by a hook and loop fastening arrangement 60, such as, conventional VELCRO brand hook and loop fasteners. It is not necessary to describe in a greater detail the particular arrangement or attachment of the hook and loop fastener to the strap members. It will be further understood that other suitable fastening means such as buckle or two long strap members will perform similar adjustable, compressive securement of the strap or straps and therefore the brace members about the ankle joint.

In a preferred embodiment of a shoe incorporating the support and binding system 14 the upper adjustable strap member 48 provides adjustable closure means for medial and lateral upper portions and medial and lateral brace members. As illustrated, the strap member 62 is advanced through a slot 62 and back over itself where another VELCRO brand hook and loop fastener 64 or its equivalent provides means for adjustable securing of the strap 48.

In another embodiment of the present invention the upper anterior strap combination is provided in lieu of conventional laces. The strap 48 is typically secured to the upper lateral portion of the shoe 10 by stitching, rivets, or other suitable fastening or attachment devices.

It will be understood that the strap arrangements may be reversed with the ring or slot provided on the medial side of the shoe upper instead of the lateral side.

In the foregoing embodiments or any of their equivalents, the upper adjustable strap 48 or laces (not shown) provide for more complete and continuous compression of the brace members 34 and 36 generally uniformly against the ankle joint of the wearer.

Referring to the preferred embodiment illustrated and described herein, it will be understood that inner compressive means, for example brace padding 42, 44, provide for compression of the bones of the ankle joint.

Knowledge of the bone structure of the foot, ankle, and leg is presumed and only a brief discussion of the ankle joint structure is included in the present description. The ankle joint is composed of three bones, including tibia, fibula, and talus.

The ankle joint further includes the articulation, hinged or jointed connection and movement of these bones with the calcaleus and additional tarsal bones. The fibula includes a distal portion forming a lateral prominence of the ankle, typically known as a medial malleolus and are joined by a syndesmosis. The distal ends of the tibia and fibula join and form a mortuus at the juncture. Held inside the mortuus, the talus provides the ankle joint with its hinge-like qualities. A series of ligaments provide joint stability.

Anatomical stability of an unsupported or braced ankle joint is provided by connection of the anterior portion of the lateral malleolus to the talus by the anterior talofibular ligament. The calcaneal fibular ligament connects the fibula to the cacaneus. The posterior talofibular ligament connects the posterior portion of the fibula to the talus. The deltoid ligament connects the tibia to the talus from an anterior, medial, and posterior perspective, thereby providing a desired ankle joint medial stability.

As previously mentioned, the sprain is the most common ankle injury. Simply defined, an ankle sprain occurs when an ankle is forced past its normal range of motion in any one of three planes. Joint motion out of the normal range typically causes tearing or separation of ligament fibers of potentially any one of the aforementioned ligaments surrounding the ankle joint.

Conventional belief would have an ankle joint sprain occur upon vigorous inversion or eversion of the joint. The present invention is constructed to inhibit ankle joint sprain upon the occurrence of a more complex motion which is believed to cause the sprain.

The present invention is particularly suited to inhibit ankle sprain caused by inversion and eversion coupled with either an external or an internal rotation of the tibia and the fibula, and motion of the talus inside the mortuus. It is believed that the most common ligament related injuries related to the ankle joint involve the anterior talofibular, the calcanea-fibular, and the posterior talofibular ligaments. It is believed that these ligament injuries occur upon internal tibia and fibula rotation while the foot is inverted.

In operation, in connection with the high-top athletic shoe 10 previously mentioned, a support means is provided to protect the ankle joint from a sprain or related ankle injury. The combination of the brace members and operatively associated strap members provide primarily medial and lateral compressive forces to prohibit or at least inhibit and otherwise help prevent eversion and inversion as well as internal and external rotation of the tibia and fibula while allowing normal dorsi and planter flexion of the wearer's foot.

The wearer's foot is placed into the shoe in the normal manner. In a preferred embodiment, the wearer's foot slips into the shoe and between the padded brace members. The brace padding protects the foot from direct contact with the brace members, which could be a semi-rigid plastic material. The straps 40 and 48 are cinched so as to firmly press the braces about the ankle. The foot is now compressed intermediate the brace members and associated padding within the shoe.

The wearer's foot is now compressed and held within the shoe with ankle joint intermediate the medial and lateral brace members. The hinged portion of the brace members allow the wearer movement or flex of the ankle joints in the anterior and posterior direction (the dorsi and planter flexion plane) and the adjustable straps and brace arrangement inhibit or limit eversion and inversion and external rotation of the tibia and fibula to reduce the possibility of an ankle sprain.

The shoe of the present invention provides the desired ankle support without detracting from the overall aesthetics of the shoe. The brace members in some preferred embodiments may slightly extend above the top of the shoe.

The primary elements of the present invention, the medial and lateral stabilizing elements or braces, the anterior dorsal strap and the adjustable upper strap have been described with respect to the components of the wearer's ankle joint and primarily the subtalor joint. It is believed that the importance of the subtalor joint has been generally overlooked in previous attempts to provide a solution for the prevention or hindrance of sprains and the support of the wearer's ankle.

The arrangement of the present invention includes medial and lateral stabilizers for preventing rotation about the longitudinal axis of the wearer's foot, a subtalor strap for preventing twisting, and an anterior tibial strap (e.g., the adjustable upper strap) for preventing forward tibia movement and rotation of the tibia, all of which assists to stabilize the talocaneal joint.

Furthermore, the combination of these three elements provide a desired and sought for stability of the ankle joint and the rear of the foot while still allowing a desired full range of motion of the foot in the dorsi and planter flexion mode.

While specific embodiments have been shown and described, many variations are possible. The present invention pertains and relates to a shoe and particularly an activity or athletic shoe that may be used in practically any type of athletic competition; for example, football, baseball, basketball, and a variety of other court sports.

It will be further understood that this invention may be designed for use with boots, such as hiking boots, camping boots, or work boots (as well as work shoes). Typically, an athletic shoe incorporating this invention is constructed from a polyurethane sole and a fabric or leather upper joined together in a conventional manner. VELCRO brand hook and loop fasteners may be replaced with any suitable, equivalent fastening means. The straps are preferably a nylon webbing.

Referring again to the drawings there is shown a improved ankle brace apparatus and combined ankle brace apparatus and shoe for another embodiment of this invention. The improved ankle brace apparatus is described in connection with a shoe incorporating the ankle brace apparatus within the layers of material of the shoe upper and shoe sole. The improved ankle brace apparatus of the present invention is particularly adapted for incorporation into a shoe and the adaptation of a lacing system and upper strap for providing the desired compression of a wearer's ankle joint.

The drawings (FIGS. 7–18) show the improved ankle brace apparatus 110 in conjunction with an athletic shoe 148. The ankle brace apparatus 110 comprises a heel member 112, one pivoting brace extension 114, and another pivoting brace extension 116.

The brace extensions pivot by means of one hinge member 118 and another hinge member 120. The one hinge member is located in one heel member side portion 122, and the other hinge member is located in another heel member side portion 124.

The heel member 112 includes a heel portion 126. A heel member lower wall 128 extends inwardly from lower portions of the heel member side portions and includes one or more lower wall extensions 130 which are intended to improve the stability of this ankle brace apparatus when it is incorporated into a shoe.

In a preferred embodiment the hinge members 118 and 120 are located at reinforced portions 122, 124, of the ankle brace apparatus. In the preferred embodiment disclosed and described, the reinforcement is provided by one hinge member boss or ear portion 132 and another hinge member boss or ear portion 134.

In a preferred embodiment the, pivoting brace extensions 114, 116 are attached to their respective hinge members by one brace hinge connector or extension 136 and another brace member hinge connector extension 138. One brace extension compression member 140 extends upwardly from its associated brace member hinge connector or extension 136 and another brace extension compression member 142 extends upwardly from its associated brace member connection or extension 138.

The pivoting brace extensions 114 and 116 are allowed to pivot even though constructed within the shoe upper by the use of one hinge assembly 144 and another hinge assembly 146. As depicted in the drawing figures the ankle brace apparatus of the present invention is incorporated into the shoe (e.g., an athletic shoe 148 (although as discussed earlier with respect to the other embodiments of the present invention, the improved ankle brace apparatus 110 can also be incorporated into any number of shoes used for either athletic or non-athletic purposes)) such that a portion of each hinge assembly 118, 120 extends through the side of the shoe.

The athletic shoe 148 that has been used for purposes of illustrating one application of the ankle brace apparatus 110, includes a tongue 150. An outline 152 defines a typical envelope of a shoe and sole combination that could have incorporated into it the ankle brace apparatus 110.

A plurality of lacing eyelets 154 (the laces are not shown in order to allow the drawing figures to illustrate the general location of the ankle brace apparatus within a shoe) are located in the lower portion of the shoe upper. The pivoting brace members 114 and 116 of a preferred embodiment of the present invention are incorporated into one shoe upper brace extension 156 and another shoe upper brace extension 158.

A compression strap 160 that is attached at one end and extends through a compression strap bracket 162 provides the means for compressing the upper extensions 156 and 158. The strap bracket 162 provides the means for compressing the upper extensions as does the strap 48 in the other embodiment previously described. Other means such as conventional lacing systems, a combination of conventional lacing systems and straps, or a plurality of straps can be used to provide compression of the upper extensions 156 and 158. Movement of the pivoting brace extensions 114 and 116 and the upper brace extensions 156 and 158 is facilitated by a rear hinge opening 164 that allows the rear portion of the shoe above the heel portion, to move as the brace extensions pivot. The hinge opening 164 may be shaped to allow incorporation of an inside collar 166. The inside collar 166 extends around the upper portion of the heel to prevent heel slippage.

One open hinge notch 168 is located proximate the bottom, of the one brace extension 156 and another open hinge notch 170 is located proximate the bottom of the other brace extension 158. These open notches 168, 170 are v-shaped to facilitate movement of the pivoting brace extensions 114 and 116 and the associated upper brace extensions 156 and 158.

Split vamp sections 172 and 174 are shown in the shoe upper 176. These split vamp sections 172 and 174 also may assist in providing shoe upper flexibility. In a preferred embodiment the split vamp sections 172 and 174 include lacing eyelets.

Figure 14:
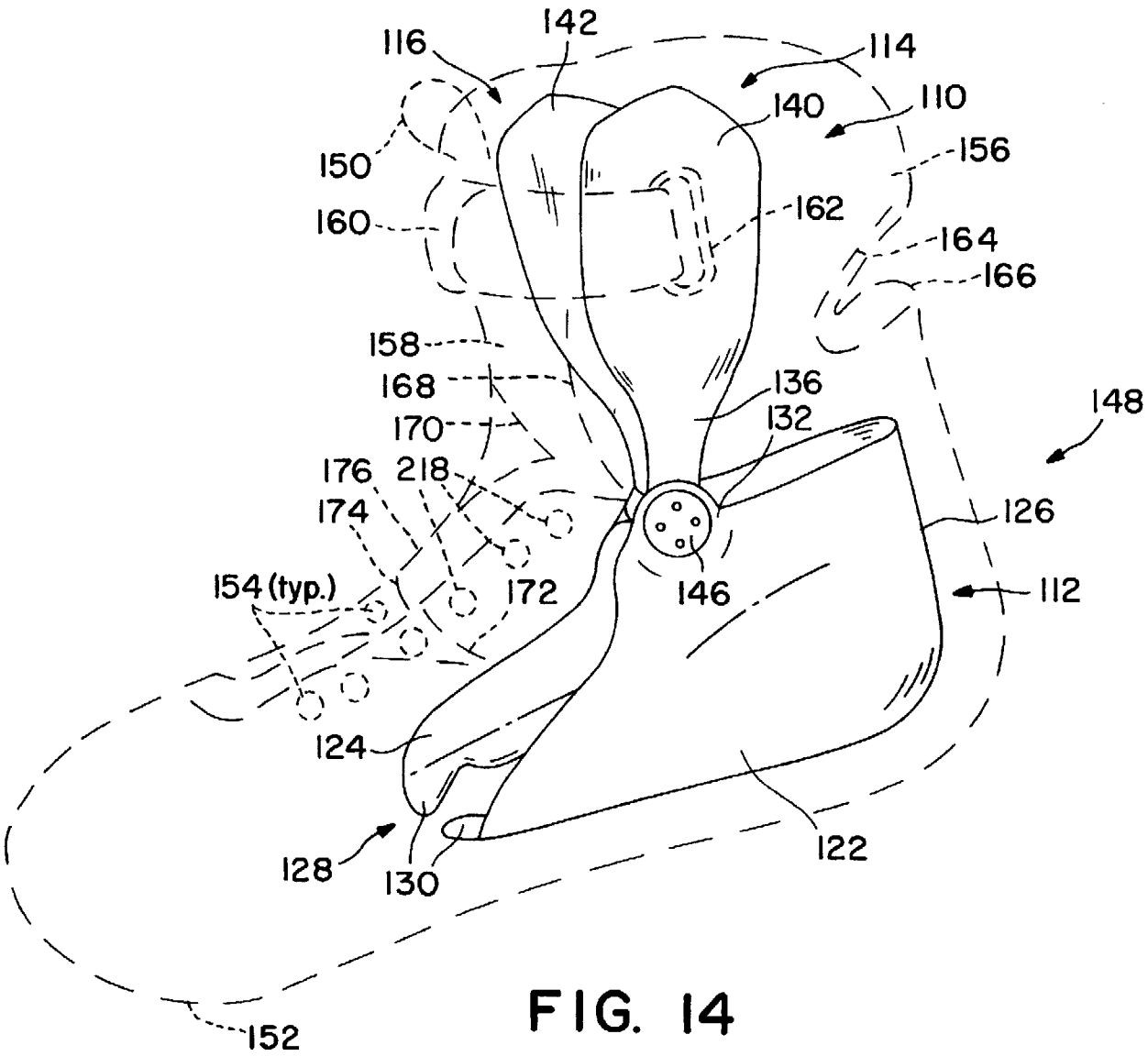
FIG. 14 is a perspective view of a shoe incorporating the improved ankle brace apparatus of the present invention depicted in FIG. 7.
Figure 15:
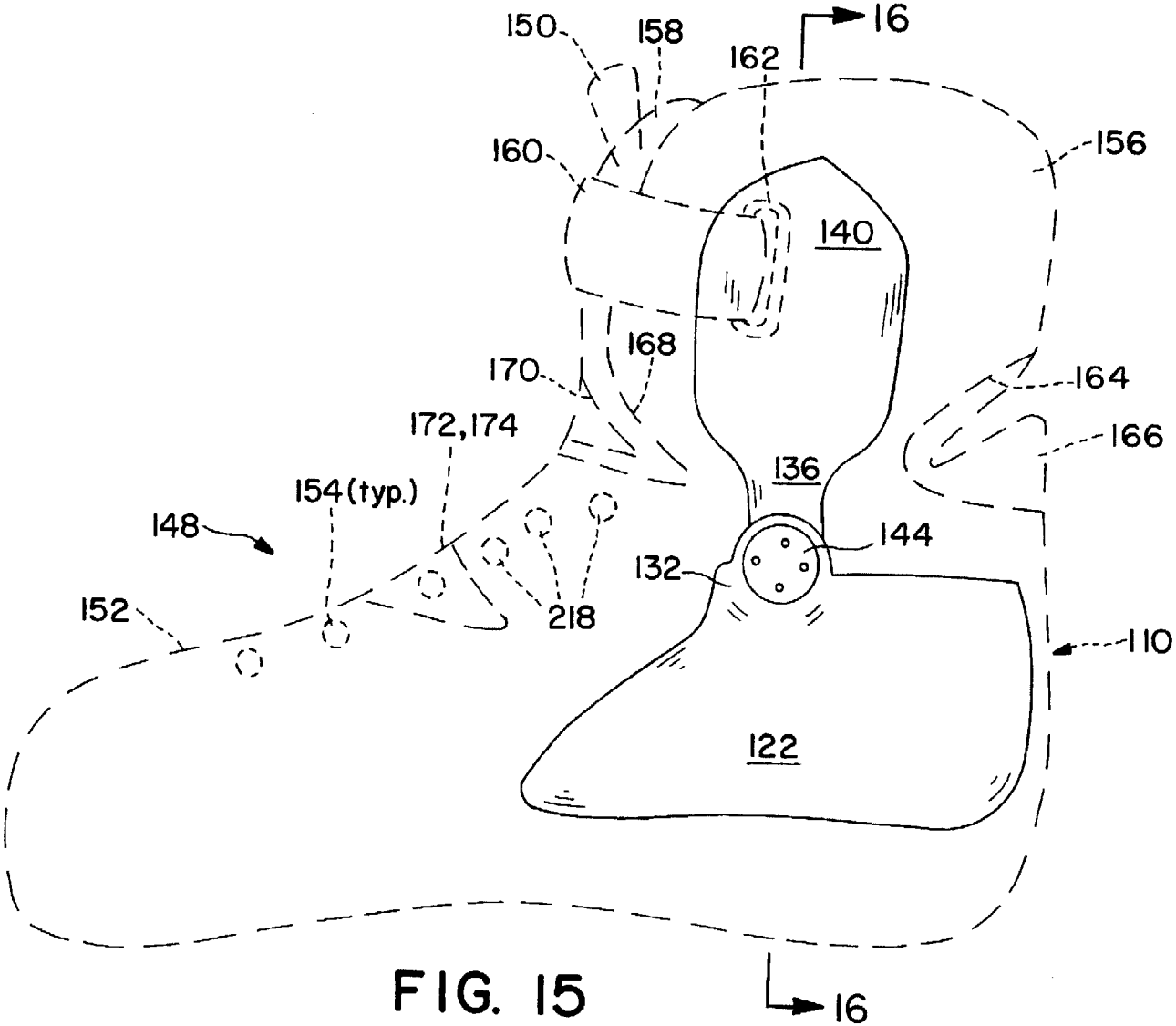
FIG. 15 is a side elevational view of the shoe and improved ankle brace apparatus depicted in FIG. 14.
Figure 16:
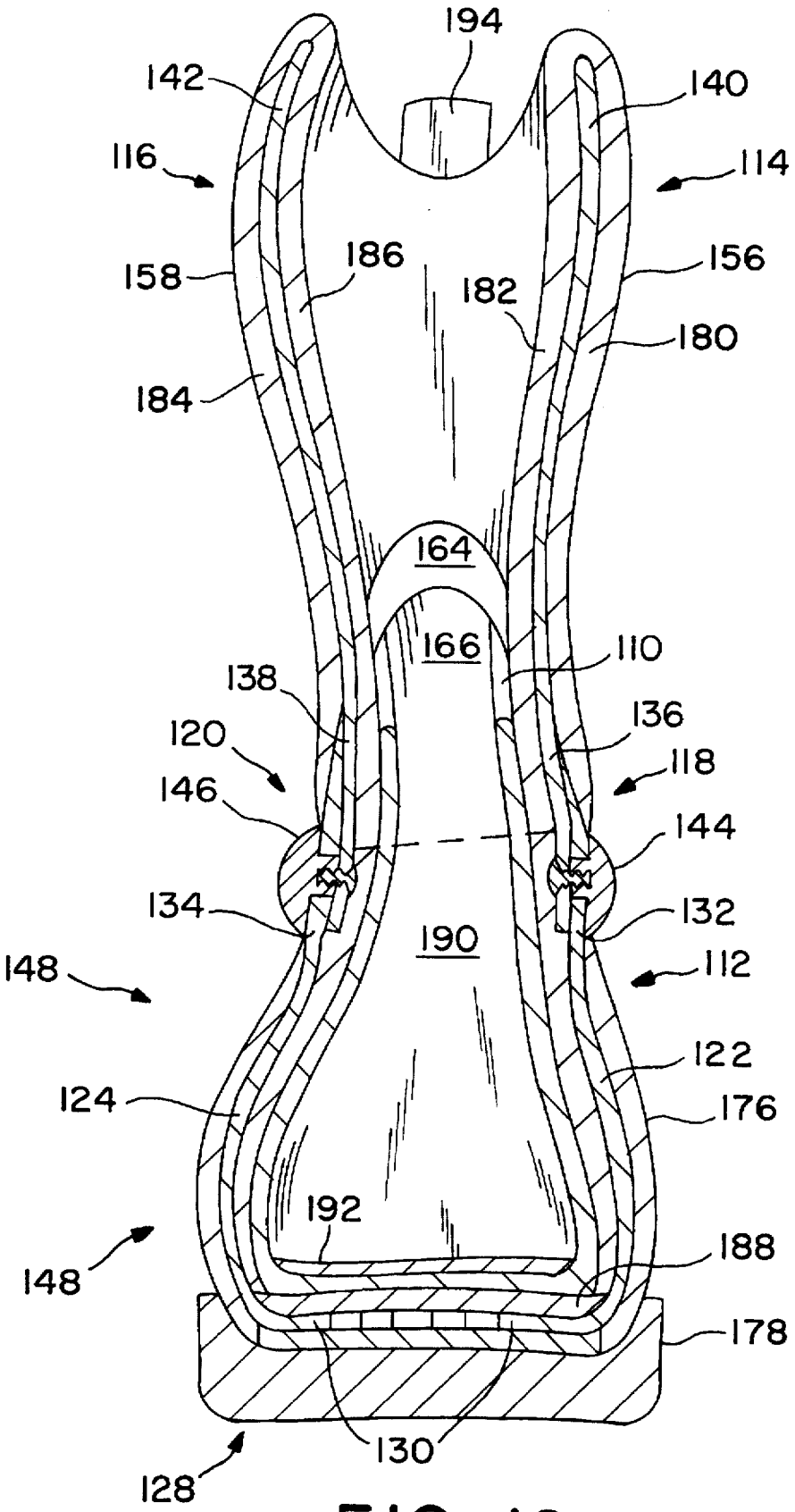
FIG. 16 is a cross-sectional view taken along line 16—16 in FIG. 15.
Figure 17:
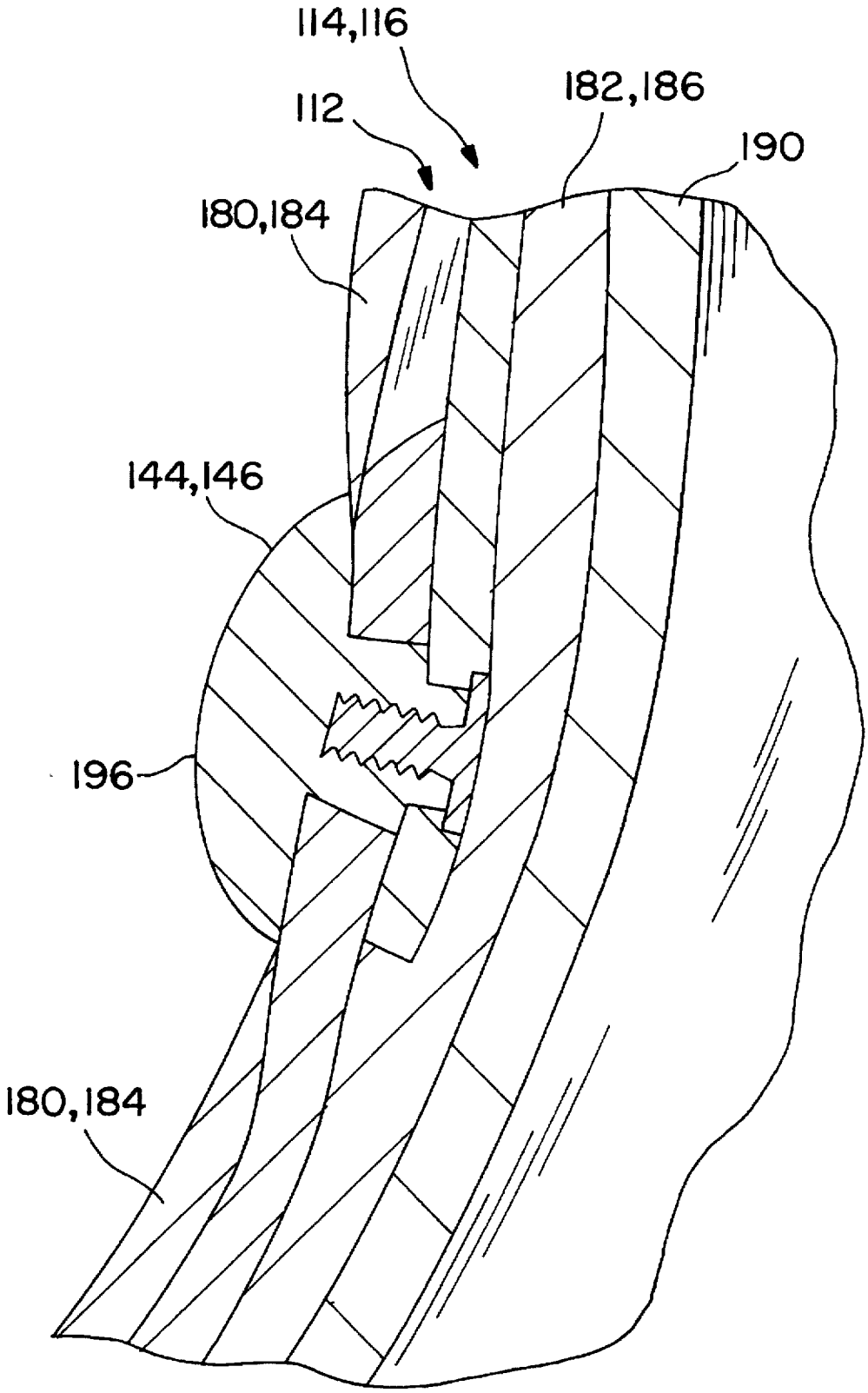
FIG. 17 is an enlarged cross-sectional view of a typical hinge of the ankle brace apparatus depicted in FIG. 7.
Figure 18:
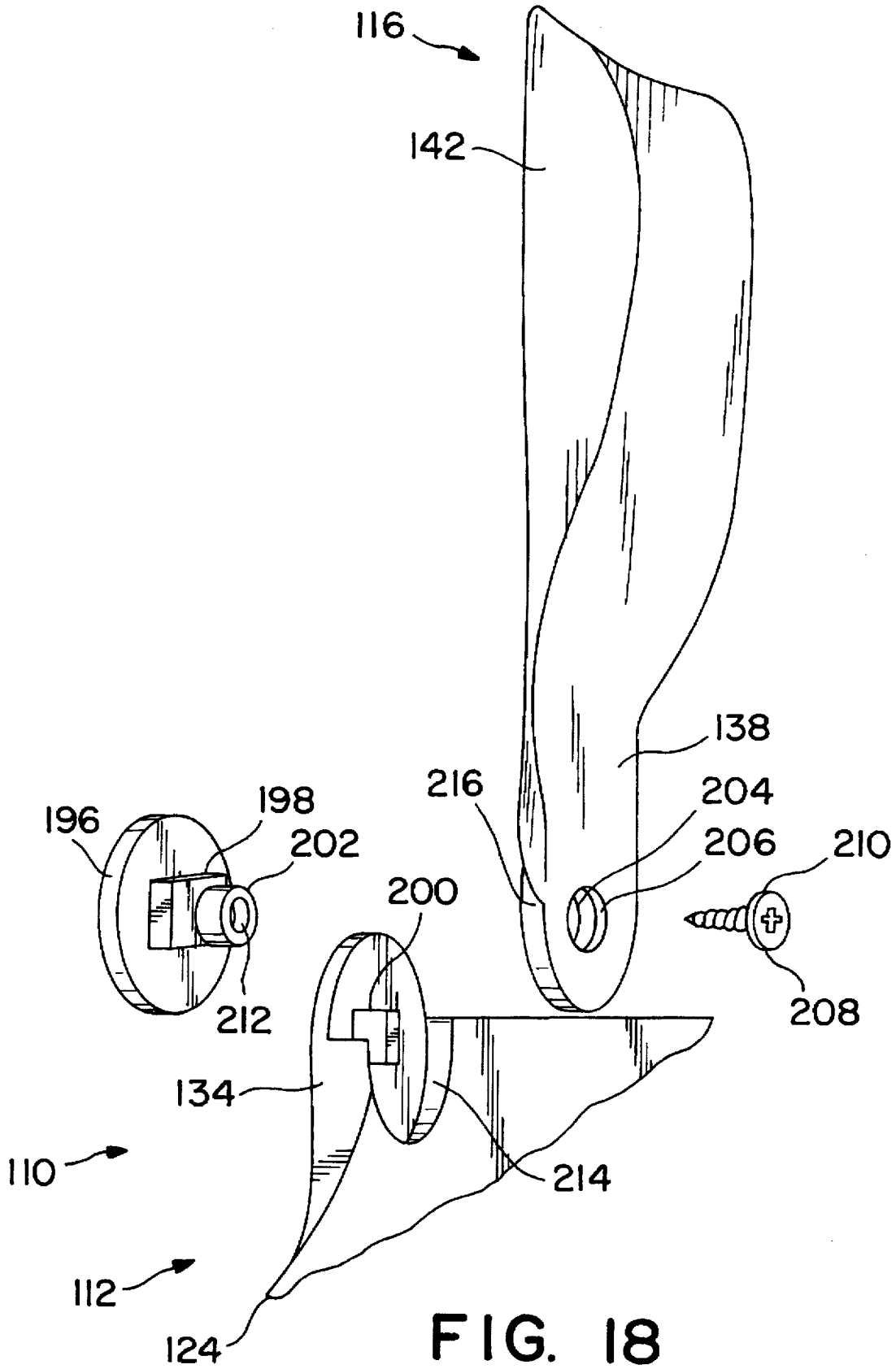
FIG. 18 is an exploded view of the hinge illustrated in FIG. 17.

FIGS. 14–16 depict a shoe upper 176 and an outer sole 178 to further illustrate a preferred embodiment of a shoe incorporating the ankle brace apparatus 110 of the present invention. It will be understood that other shoe constructions may also be used to incorporate the preferred embodiment of the ankle brace apparatus 110.

As seen in the drawings there is one shoe upper brace extension outer layer 180 and one shoe brace extension inner layer 182. On an opposing side of the shoe there is another shoe upper brace extension outer layer 184 and another shoe upper brace extension inner layer 186.

In a preferred embodiment of the shoe 148 there is included an inner sole 188, a separate shoe upper heel liner 190 and a sock liner 192. A brace extension tab 194 can be provided to assist in inserting a wearer's foot into the shoe with its upper extensions.

The ankle brace apparatus 110 is placed within the layers 180, 182 and 184, 186. The lower wall extensions 130 of the heel member 112 are located beneath and held in place by the inner sole 188. It will be understood that if the lower wall extensions 130 are such that they could be located on or between other portions or layers depending upon the type of shoe and shoe construction since the present invention is not limited to a particular type of shoe or shoe construction.

In a preferred embodiment the hinge members 118 and 120 include a hinge button 196 that extends out of the associated upper extension layer. The hinge button in one preferred embodiment includes a square shoulder extension 198 that is received by a similarly shaped square opening 200 in the respective boss or ear portion.

It will be understood that the square shape of the preferred embodiment shown and described can be modified, a criteria being that the button 196 is held in place against rotation of the axle member of the hinge or pivot that is received in a further extension, e.g., circular extension 202. The circular extension is received in a circular opening 204 in the respective brace member hinge connectors or extensions 136 and 138.

In the preferred embodiment described herein the circular opening 204 includes a counter-sunk shoulder 206. A hinge pin or fastener 208 (e.g., a Phillips head screw including a washer (not shown)) has ahead 210 or a shoulder on the underside of the head that fits into the counter-sunk shoulder 206 which reduces the chances of the head of the fastener or axle to extend outward from the hinge, a possible point of friction between the hinge member and the wearer's foot. Other fastening means can be used to connect the hinge button 196 to the hinge connectors or extensions 136 and 138. For example, such fastening means can include a washer and rivet combination or other similar devices. Further, the fastening means may or may not include a head as previously described.

An opening 212 in the extension 202 of the hinge button 196 receives the fastener, i.e., axle member of the hinge assembly. The reinforced portion or boss or ear or the hinge assembly includes a shoulder 214 that receives the respective brace member hinge connector or extension 136 or 138 which in turn includes contoured end 216 that is supported by and rides in the shoulder 214.

In operation, the shoe upper 176 incorporating the improved ankle brace apparatus 110 of the present invention is compressed against the wearer's foot and in particular the ankle of the wearer's foot. Compression of the ankle brace apparatus 110 against a wearer's foot is provided for by adjusting the upper compression strap 160 (corresponding to the strap 48 in another embodiment of the invention). In the presently described preferred embodiment of the improved ankle brace apparatus incorporated into a shoe upper and sole combination, one or more compression lacing eyelets 218 are located generally along the desired line from the opposing hinge members 118 and 120 as that previously described and illustrated for strap 40.

The improved ankle brace apparatus provides for additional foot support with the incorporation of a heel member. The ankle brace apparatus can be made from a number of materials such as a thermosetting plastic or similar materials. It has been found that the incorporation of the ankle brace apparatus into a shoe allows the pivoting brace extensions and the heel member to be constructed from relatively lighter weight materials having a thickness less than that associated with conventional ankle braces as the shoe itself is incorporated into the desired functioning of the invention.

It is believed that the improved ankle brace apparatus will provide greater ankle and heel protection, a more comfortable fit, and will be more comfortable to wear during either strenuous or leisure activities than prior art devices. The improved ankle brace apparatus and the details of the particular shapes of the various components can be readily modified to fit a particular shoe, or a particular wearer (as in a specially designed orthopedic support with the heel member and pivoting brace extensions shaped to fit each of wearer's feet and lower leg regions), or a particular sport.

It will now be understood that an improved ankle brace apparatus has been disclosed and described. Those skilled in the art will recognize that the improved apparatus incorporated in to the construction of a shoe should be more stable, not slip while compressed and provide for better support at the ankle and around the heel portion of the wearer's foot.

Having described the invention in detail, those skilled in the art will appreciate that modifications may be made of the invention without departing from its spirit. Therefore, it is not intended that the scope of the invention be limited to the specific embodiments illustrated and described. Rather, it is intended that the scope of this invention be determined by the appended claims and their equivalents.

What is claimed is:

1. A shoe providing ankle support, comprising:

an upper member including a vamp portion and a heel counter;

an sole attached to said upper member;

a heel cup connected to said sole, said heel cup having a heel collar;

a heel member of unitary construction forming a continuous enclosure about the heel of a wearer, and disposed within an internal space defined by said upper member, said sole, and said heel cup, said heel member comprising a pair of side walls and a lower wall, each of said side walls having a reinforced section adjacent the wearer's ankle, and said lower wall having a plurality of wall extensions lying parallel to said sole for stabilizing said heel member;

a pair of braces comprising a rigid material;

a pair of hinge assemblies, each hinge assembly connecting one of said braces to one of said side walls at said reinforced section;

a pair of brace extension members extending above the wearer's ankle, each of said brace extension members comprising an inner layer and an outer layer encircling one of said braces; and a rear extension member connecting said brace extension members and defining an aperture with said heel collar;

wherein each of said brace extension members pivots about the axis of the wearer's ankle in response to movement thereof.

2. The shoe according to claim 1, further comprising a strap member connected to each of said brace extension members for securing said brace extension members about the wearer's ankle.

3. The shoe according to claim 1, wherein each of said brace extension members defines a v-shaped notch with said vamp portion.

4. The shoe according to claim 1, wherein said rear extension further comprises an extension tab.

5. The shoe according to claim 1, wherein each of said braces comprises a thermoplastic material.

6. The shoe according to claim 1, wherein each of said reinforced sections comprises a boss having a first opening defined therein.

7. The shoe according to claim 6, wherein each of said brace extension members has a second opening defined therein.

8. The shoe according to claim 7, each of said hinge assemblies being disposed within one of said first and second openings.

9. The shoe according to claim 1, further comprising a liner disposed on a surface of said lower wall of said heel member overlaying said plurality of wall extensions.

10. A shoe providing ankle support, comprising:

a support member comprising:

a heel member forming a continuous enclosure about the heel of a wearer, said heel member comprising a medial portion and a lateral portion, said medial portion having a first shoulder and said lateral portion having a second shoulder;

a medial brace member having a first contoured end connected to said first shoulder via a first hinge assembly, said first hinge assembly defining a first pivot point;

a lateral brace member having a second contoured end connected to said second shoulder via a second hinge assembly, said second hinge assembly defining a second pivot point;

an external member surrounding said support member, comprising:

a vamp portion having a medial side portion, a lateral side portion, and a heel counter;

a sole portion connected to said vamp portion such that said heel member is enclosed by said sole portion and said vamp portion;

a medial brace extension surrounding said medial brace member, said medial brace extension defining a first v-shaped notch with said medial portion at said first pivot point;

a lateral brace extension surrounding said lateral brace member, said lateral brace extension defining a second v-shaped notch with said lateral portion at said second pivot point;

a rear extension connecting said medial brace extension and said lateral brace extension, said rear extension having an opening defined therein to facilitate movement of said medial brace extension and said lateral brace extension in response to movement of the wearer's ankle, said opening lying in a horizontal plane with said first v-shaped notch and said second v-shaped notch; and a strap member disposed between said medial brace extension and said lateral brace extension, compressing said medial brace extension and said lateral brace extension against the wearer's ankle.

11. The shoe according to claim 10, wherein each of said medial brace extension and said lateral brace extension comprises an inner layer and an outer layer.

12. The shoe according to claim 10, wherein said rear extension further comprises an extension tab.

13. The shoe according to claim 10, wherein said heel member further comprises a lower portion lying parallel to said sole portion.

14. The shoe according to claim 13, wherein said lower portion comprises a plurality of lower extensions for stabilizing said heel member.

15. The shoe according to claim 10, wherein each of said first and second hinge assemblies comprises a hinge extension and a cooperating fastener.

16. The shoe according to claim 15, wherein said hinge extension further comprises a hinge button.

17. The shoe according to claim 10, wherein said medial brace member and said lateral brace member each comprises a rigid member comprising a first end having a first width, and a second end having a second width, wherein said first width is less than said second width.

18. The shoe according to claim 10, further comprising a heel cup connected to said sole portion, said heel cup having a collar.

19. The shoe according to claim 18, wherein said collar and said rear extension define said opening.

20. A shoe providing ankle support, comprising:

a heel member extending continuously from the wearer's heel and terminating at the wearer's ankle, said heel member comprising a medial wall having a first reinforced section, a lateral wall having a second reinforced section, and a lower wall comprising a plurality of wall extensions, said lower wall lying perpendicular to said medial wall and said lateral wall;

an upper member surrounding said medial wall and said lateral wall of said heel member;

a sole connected to said upper member and surrounding said lower wall of said heel member, a medial brace member covering a medial side of a wearer's ankle, said medial brace member having a first width that gradually increases as said medial brace member extends above the wearer's ankle;

a lateral brace member covering a lateral side of a wearer's ankle, said lateral brace member having a second width that gradually increases as said lateral brace member extends above the wearer's ankle;

an extension member connected to said upper member and defining a pair of notches therewith, said extension member comprising a plurality of layers for enveloping said medial brace member and said lateral brace member, said layers having a pair of strap-receiving apertures defined therein;

a pair of hinge members pivotally connecting said heel member to said medial and lateral brace members at said first and second reinforced sections, respectively, wherein each of said hinge members terminates at a point on an external surface of said extension member adjacent one of said notches; and a strap disposed within said strap-receiving apertures for compressing said medial brace member and said lateral brace member against the wearer's ankle.

21. The shoe according to claim 20, further comprising a liner overlaying said plurality of wall extensions.

22. The shoe according to claim 20, wherein said extension member further comprises an extension tab.

23. The shoe according to claim 22, wherein said extension member further defines a hinge opening adjacent said extension tab.

24. The shoe according to claim 20, wherein each of said first and second reinforced sections comprises a boss having a opening defined therein for receiving one of said hinge members.

* * * * *